US005331564A

United States Patent [19]

Barea

[11] Patent Number: 5,331,564

[45] Date of Patent: Jul. 19, 1994

[54] DEVICE FOR VERIFYING THE CORRECT EMPLOYMENT OF THE YARNS USED IN A TEXTILE MACHINE, IN PARTICULAR A KNITTING OR HOSIERY MACHINE

[75] Inventor: Tiziano Barea, Busto Arsizio, Italy

[73] Assignee: International Trading S.R.L., Italy

[21] Appl. No.: 684,333

[22] Filed: Apr. 12, 1991

[30] Foreign Application Priority Data

Apr. 20, 1990 [IT] Italy ..... 20087 A/90

[51] Int. Cl.[5] ..... G06F 15/46

[52] U.S. Cl. ..... 364/470; 66/132 R

[58] Field of Search ..... 364/470, 474.15, 474.22, 364/474.25, 138; 66/132, 157, 166, 163; 242/47.01

[56] References Cited

U.S. PATENT DOCUMENTS

| | | | |
|---|---|---|---|
| 4,736,324 | 4/1988 | Sainen et al. | 364/138 X |
| 4,744,227 | 5/1988 | Whitener, Jr. | 66/163 |
| 4,764,875 | 8/1988 | Carrotte et al. | 364/470 |
| 4,835,699 | 5/1989 | Mallard et al. | 364/470 |
| 4,839,815 | 6/1989 | Eaton et al. | 364/470 |
| 4,953,367 | 9/1990 | Memminger et al. | 66/132 R |
| 5,119,308 | 6/1992 | Samoto | 364/470 |
| 5,136,499 | 8/1992 | Rydborn | 364/470 X |

*Primary Examiner*—Jerry Smith
*Assistant Examiner*—Brian C. Oakes
*Attorney, Agent, or Firm*—Steinberg, Raskin & Davidson

[57] ABSTRACT

A device for verifying the correct employment of the yarns used by a textile machine, which enables improper use, inexact feed velocity of each yarn used and inexact length of the machine operating cycle to be indicated, and in addition measures the consumption of each yarn used for the fabric.

19 Claims, 3 Drawing Sheets

DEVICE FOR VERIFYING THE CORRECT EMPLOYMENT OF THE YARNS USED IN A TEXTILE MACHINE, IN PARTICULAR A KNITTING OR HOSIERY MACHINE

This invention relates to a device for verifying the correct employment of the yarns used by a textile machine, in particular a knitting or hosiery machine.

These machines manufacture fabric composed of differently used sequences of the available yarns. At each moment of operation of the machine a sub-group of the total group of yarns present is therefore being used.

The high machine working speed means that the fabric or article can be inspected only when completed. At this point the operator visually checks whether the article produced corresponds to the master, and if this is not the case that article and those produced subsequently up to the end of the checking procedure have to be discarded.

A visual check can obviously be unprecise, allowing errors to slip through with serious repercussion on the subsequent operating stages.

For example, it is very difficult to determine by sight whether the article produced is slightly longer or shorter than the master article, or whether a certain yarn has been used for too many or too few cycles. In the hosiery field this means that on termination of production, personnel have to be provided to correctly pair the various items produced.

A computer-controlled machine is already known which senses and memorizes by means of sensors whether and when the various yarns are used for a given production on the textile machine, and then subsequently uses the reference information obtained during this stage, known as the learning stage, for controlling the subsequent production via a comparison operation.

This machine has certain drawbacks, one of which is that it does not provide adequate handling of the errors. It simply accumulates then in a counter, and when this counter reaches a predetermined threshold the machine is set into the error state. Thus the machine is set into the error state only by a series of errors detected for different yarns, whereas these errors if considered individually, i.e. in relation to each individual yarn, could well be negligible.

A further drawback is that the known control device sets the textile machine into the error state and halts it only on termination of production of the master or article. This could result in serious breakage or malfunction of the textile machine, due for example to the impact of needles against fixed parts, because the textile machine continues to operate even if the yarn employment is in error.

A further drawback is that the device does not indicate an out-of-phase state, i.e. that the article production stage is for various reasons longer or shorter than the master production stage, i.e. the optimum, so resulting for example in stockings longer or shorter than normal and which have then to be properly paired, this not being always easy to do.

A further drawback is that the device does not enable the textile machine to be used to produce articles involving several operating stages (such as pantie hose) as it considers the basic operating stage of the textile machine to be the only possible stage, and does not allow further stages. Neither can the device be used for producing articles which do not have a proper end or a proper beginning, such as tablecloths and the like.

The final drawback is that the device does not measure the yarn feed velocity, and thus when working terry cloth or vanise it visualizes correct operation even when certain of these yarns are not used to produce the loop but to produce the reference weft for example of the stocking.

An object of the invention is to memorize the exact number of revolutions of the textile machine drive shaft or a multiple thereof undergone during a learning cycle, in order to detect a possible machine fault or error which has caused a variation in the duration of an operating cycle, or a mistake in the setting of the production cycle by the operator on starting a new production. A further object is to provide precise information on the type of error which the machine has committed, or whether the yarn has not been taken up by the machine or has been taken up in error, the number of interventions for each yarn and for each type of error, and whether the machine is out of phase.

A further object is to monitor not only the movement or lack of movement of the yarn fed to the textile machine but also the velocity with which these yarns are fed during the learning stage, to be able to indicate any abnormality deriving from an excessive difference between the yarn feed velocity and that memorized. A further object is to provide more appropriate handling of the error by instantaneously halting the machine (even if it has not reached the end of the cycle) when the same type of error has been sensed by the same sensor a predetermined number of times.

A further object is to provide an approximate measurement in terms of percentage of yarn utilization, to thus provide the user (by associating said percentages with correction constants based on the type of yarn and the type of knitting produced) with the true percentages of each yarn used during operation, so avoiding the traditional weighing of the yarn bobbins before and after the master production cycle to determine the amount of yarn used. These and further objects which will be apparent from the description given hereinafter are attained according to the present invention by a device for textile machines in accordance with the accompanying claims.

The present invention will be more apparent from the description given hereinafter by way of non-limiting embodiment with reference to the accompanying drawings in which.

Figure 1:
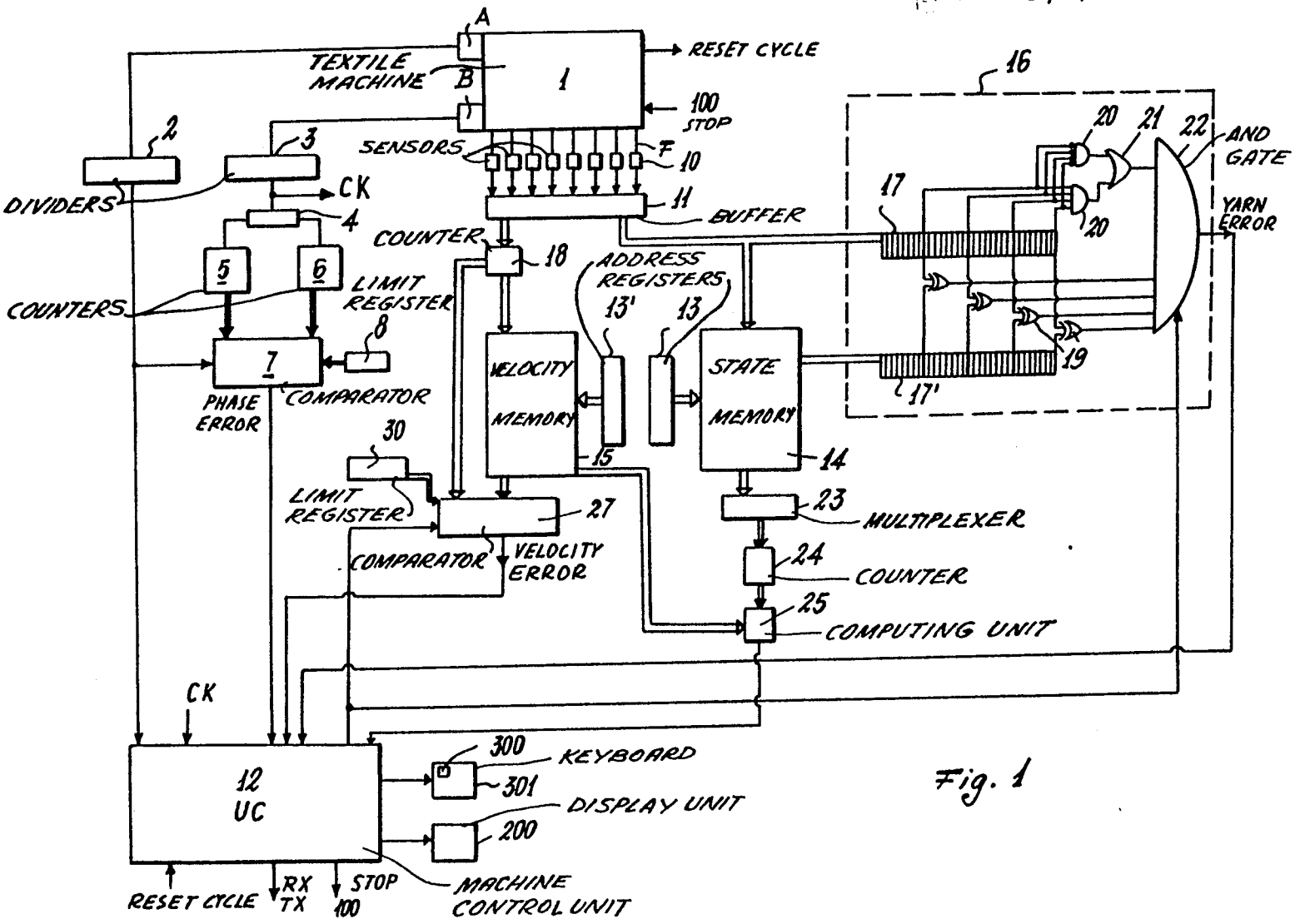
FIG. 1 is an overall block diagram of a textile machine with its controls.

With reference to said figures, a time reference signal is obtained from a proximity sensor B located on the drive shaft of a textile machine 1 and a cycle commencement and termination signal is obtained from a switch A located on the cylinder of the textile machine, which is of circular type.

The cycle commencement and termination signal enters a divider 2 which enables the total control cycle to be computed within one or more textile machine cycles, and the time reference signal enters a divider 3 to allow correct synchronization of the control device at the textile machine. The output of the divider 3 operates as a timer pulse CK for the control device.

The output signal from the divider 3 is fed in turn by a change-over switch to two counters 5, 6 the outputs of which are connected to a comparator 7 provided with a third input connected to a limit register 8 able to generate an error signal at the end of the cycle if the two counters differ by more than the value memorized in the limit register 8, having been previously set on the basis of the acceptable tolerance. These components represent that part of the device concerned with checking the cycle length.

Sensors 10 are positioned at the feed yarns F to the textile machine 1 to both sense the movement and measure the velocity of each individual yarn. For simplicity eight sensors are shown, but their number depends on the number of yarns used in the textile machine. The sensors 10 communicate their data to a buffer register 11 which in cooperation with the textile machine control unit 12 and address registers 13, 13' enables the data obtained by said sensors to be stored in a memory 14 relative to the yarn state (at rest or in movement) and in a memory 14 relative to the yarn velocity.

For example, each bit of the state memory 14 represents the state of movement of the yarn, i.e. whether said yarn is moving or whether the yarn F of any of the eight sensors 10 at a precise and definite moment in time is interrupted by timing pulses as described hereinafter, whereas a byte of the velocity memory 5 represents the yarn velocity determined by each individual sensor.

The state memory 14 and the buffer register 11 are connected to a circuit 16 for detecting errors in the form of a broken or incorrectly used yarn. The purpose of this circuit is to indicate if the detected error has been sensed as having occurred several times by the same sensor 10, and in such a case to indicate a "yarn error".

Said circuit 16 consists of two shift registers 17', 17 which serialize the data received from the memory 14 and from the buffer 11. The length of these registers is chosen on the basis of the number of errors to be detected and the number of sensors present. Said registers are provided with intermediate outputs to enable the value of the bits present to be checked. For example these outputs are positioned at the bits corresponding to multiples of the number of sensors present.

Each shift register 17, 17' serially memorizes four successive sensor states, i.e. three already determined states plus the current state are present in one shift register 17, while in the other 17' the four corresponding states determined during the master cycle and memorized in the state memory 14 are present.

Coincidence circuits (for example exclusive OR) 19 compare the value of the output bits of the two registers 17, 17'. In this manner they determine whether four states relative to a particular sensor differ from the four states stored in the state memory 14, and thus indicate if there are four consecutive errors. To the same outputs of one shift register (for example 17) there are connected AND circuits 20 in series with an OR circuit 21 to indicate whether these errors are of the same type, for example whether there are four zeros in a row indicating four yarn breakage errors, or four ones in a row indicating four yarn erroneously used errors.

The outputs of the four exclusive ORs 19 and of the OR 21 are connected to a total AND 22 which indicates the presence of errors of the same type at the same sensor. The register shift is suitably controlled by the control unit 12.

The yarn velocity is measured for example on the basis that the sensors 10 in addition to indicating the yarn state also provide a pulse frequency proportional to the velocity of each yarn. This frequency is measured by the buffer register 11 (or simply buffer) and stored in a counter 18, the value of which is then stored in the velocity memory 15. The velocity memory 15 is controlled by a comparator 27 which compares the value in the counter 18 with the value stored in the velocity memory 15; the comparator 27 indicates a velocity error if the compared values differ by more than a value stored in the limit register 30.

The part which calculates the quantity of yarn used consists of a multiplexer 23, a counter 24 and a usual computing unit 25. The multiplexer allows selection of which bit and therefore which yarn is to be considered. This multiplexer is connected to the state memory 14, which is suitably scanned by the address register 13, the number of "one" bits found during this scanning being memorized in the counter 24. Said counter is connected to a computing unit 25 which using the data stored in the memory 15 also provides data relating to the percentage of yarn used and the total quantity of yarn used.

Figure 2:
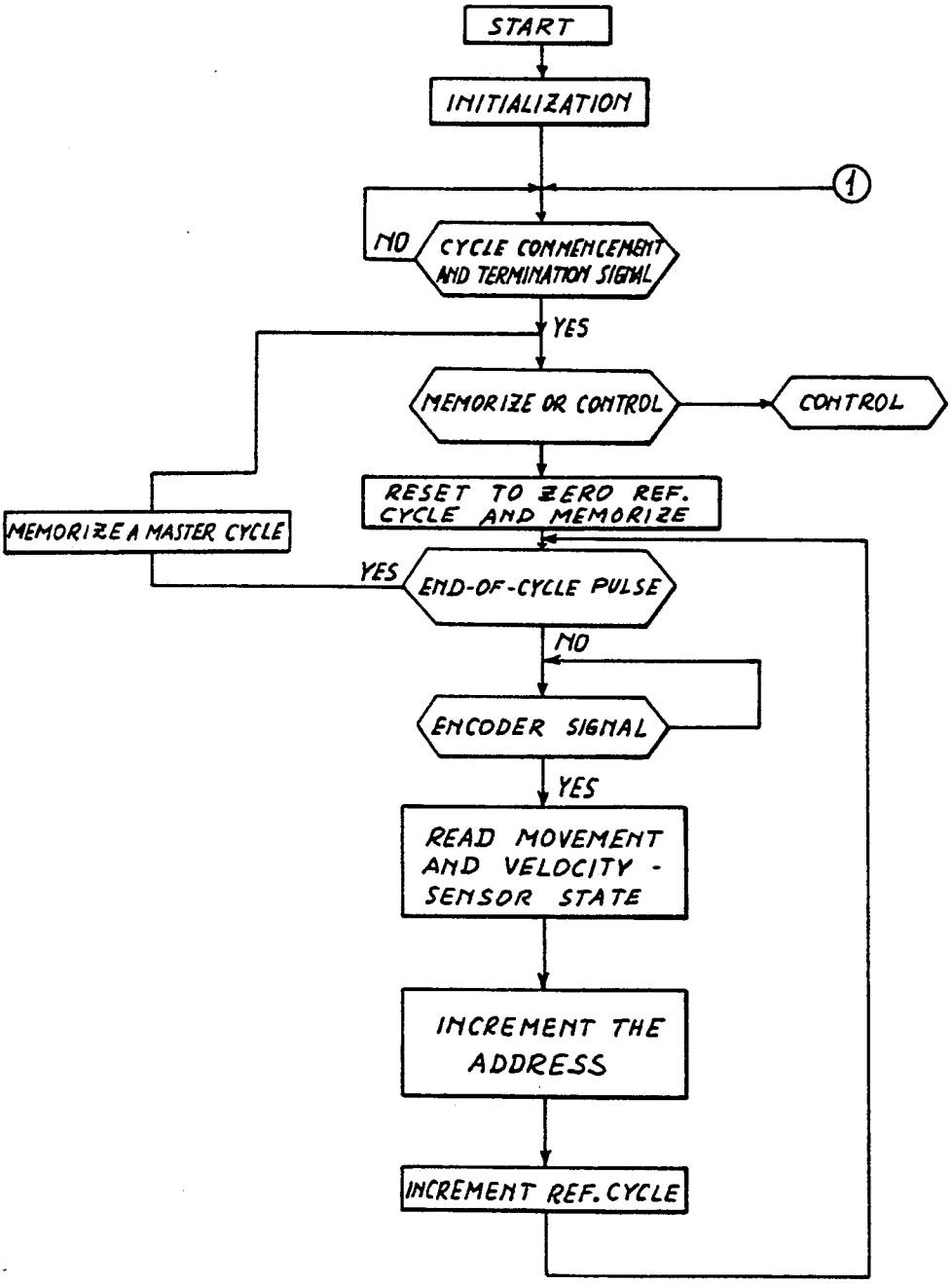
FIG. 2 is a flow diagram showing the steps necessary for memorizing the master article.

The control unit 12 receives at its input all the signals required for the correct operation of the machine 1 (timer, end-of-cycle signal, reset signal etc.) originating from the divider 2, from the comparator 7, from the AND gate 22, from the unit 25 and from the comparator 27. The unit 12 also generally handles the signals required for correct operation of the device comprising the members described up to this point (divider 2, sensors 10, memories 14, 15, logic gates 20, 21, 22 etc.) on the basis of the signals generated by the members themselves and the operations chosen by the user for the correct operational sequence. The unit 12 is also able to operate on a reception and transmission signal (RX and TX in FIG. 1) which enables information to be fed to and be received from an external computer (not shown) so that the velocity memory 15 and state memory 14 can be stored permanently on a magnetic memory and then reloaded subsequently from this memory, to thus avoid the need to repeat self-learning cycles. With reference to FIG. 2, after initialization the device waits for the machine to supply a cycle commencement and termination signal. It then enables the choice to be made whether to memorize a master cycle or to control a working cycle.

If the master cycle memorization is chosen, for each timing pulse the sensors are read together with their frequency. Information is then fed into the state memory 14 and into the velocity memory 15 until a further cycle commencement and termination signal is sensed, indicating that the first cycle has ended.

Data acquisition is achieved in the following manner: on arrival of the timing pulse CK, the data fed by the various sensors 10 into the buffer 11 are read and its content fed to the state memory 14. The counter 18 is then zeroed and the frequency which each sensor 10 generates is read, i.e. the value which the counter 18 memorizes after a predetermined time interval. This value is finally fed into the velocity memory 15, suitably incrementing the address of the address registers 13'.

When the state and frequency have been memorized for all sensors present, a check is made to determine whether the acquisition cycle has terminated. If it has not, a further timing pulse CK is awaited to determine the new signals supplied by the sensors. In the meantime for each timing pulse the reference counter 5 is incremented by one. On termination of the acquisition cycle the two memories contain data representing a digital "image" of the fabric produced, this image being composed of the state of the sensors and the velocity measured by them. In addition, the reference counter 5 contains the number of timing pulses required for an entire machine cycle.

On termination of the acquisition, either a new master cycle can be acquired or the next operation controlled.

Figure 3:
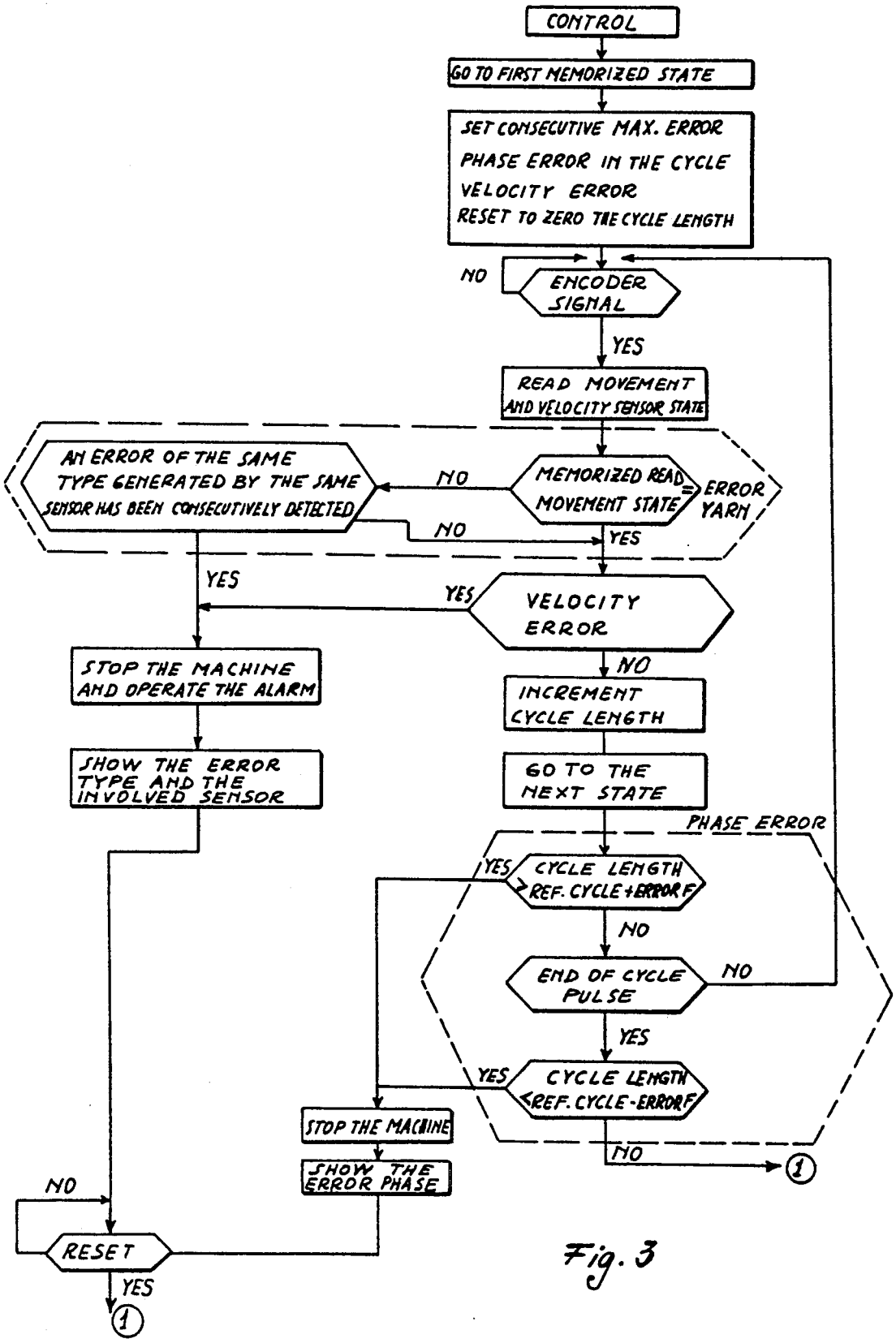
FIG. 3 is a flow diagram showing the steps necessary for controlling the subsequent articles.

With reference to FIG. 3, on choosing to control the next operation the extent of acceptable errors must firstly be keyed in, i.e. the acceptable cycle length error compared with the master cycle in the limit register 8, the maximum acceptable velocity error compared with the yarn velocity in the limit register 30, and the number of errors of the same type at the same sensor to be allowed before indicating a total error.

The control unit 12 then sets the two address registers 13, 13' of the memories 15 and 14 to the first address. On receipt of the synchronization pulses from the proximity sensor B the state of the sensors 10 is read in the shift register 17, while the addressed master state 13 is fed to 17', in which three previous states are already stored, as stated. The exclusive OR circuits 19 check whether four errors are present between the two states, while the AND gate 20 and OR gate 21 determine whether these errors are of the same type.

Signals are then fed from the OR gates 19 and OR gate 21 to the AND gate 22, which at its output provides an error signal only if an error of the same type generated by the same sensor had been detected.

This error signal is fed to the control unit 12 which instantly (rather than at the end of the cycle) halts the machine and operates an alarm via a stop signal 100. The control unit 12 also displays on a display unit 200 the type of error and the sensor involved by suitably investigating the support circuits not registered in the shift register 17, 17'.

If a state error has not been detected, at this point the control unit 12 determines whether a velocity error has been provided by the comparator 27 which checks whether the number indicating the velocity of the sensor addressed by the address register 13' is equal to that memorized by the counter 18 by less than the value in the limit register 30.

If there is no velocity error present the address registers 13, 13' are set to the commencement of samples obtained at the next timing pulse during the learning state, after which the control unit 12 checks via the comparator F and the connected circuits whether a first out-of-phase error exists, evaluating if the pulses determined by the sensor B exceed a maximum acceptable value plus the set phase error value. If this is not the case, the control unit 12 acquires further data if a cycle has terminated, or repeats its yarn state analysis on receiving pulses from the sensor B.

If an end-of-cycle pulse has been received, a second out-of-phase error check is made by evaluating if the pulses received from the sensor B are less than a maximum acceptable value less the set phase error.

If a phase error is detected, the control unit 12 indicates the type of error and halts the machine.

With the machine halted, the control unit 12 waits for the appropriate pushbutton 300 present on the keyboard 301 to be pushed, to enable it to start again from the beginning. If errors are found, the unit checks whether the machine operator has selected a so-called reset cycle to enable the machine to commence a new cycle and abandon the old. In this case the state and velocity errors must not be taken into account. The control unit 12 does this by suitably disenabling the output from the comparator 27 and AND circuit 22, to prevent the error signal generated by them from further shutting down the machine during this reset cycle.

In a modified embodiment the circuit for detecting the state error 16 can also consist of counters (two for each yarn) which memorize consecutive broken yarn or erroneously used yarn errors. These counters generate the error state signal when their value exceeds a predefined value.

The counter is incremented only if an error of its type is present, whereas it is again zeroed if at that moment of time there is no error relating to its type and its sensor.

As can be seen from the flow diagrams relating to the operation of the device (FIGS. 2, 3), part of the device can be in the form of either hardware or software. For example the phase checking circuit and the error checking circuit can be formed totally with software, the choice depending entirely on the design.

What I claim is:

1. A device for verifying the correct employment of yarns used by textile machines, comprising means for monitoring the movement of the yarns used for forming a fabric, sensor means for sensing the commencement of a textile machine cycle for producing a fabric article, means for measuring the operational velocity of the textile machine, means for memorizing the information regarding yarn movements obtained during the production of a master fabric in an initial cycle of the textile machine, comparator means for comparing the yarn movements during the production of fabrics subsequent to the master fabric, said comparator means comprising means to evaluate both the movement of the yarn and the velocity of the yarn if any during the master cycle and during a current cycle in which the textile machine is operating subsequent to the master cycle, means for detecting any error between the yarn movements relating to the master fabric and the subsequent movements, said means for detecting the yarn movement error comprising means for detecting consecutive errors at a same one of said sensor means, means for determining whether the consecutive errors are of the same type, and indicator means for indicating a general error, a general error being indicated by said indicator means only if an error indication is provided by both said means for detecting consecutive errors at a same one of said sensor means and said means for determining whether the consecutive errors are of the same type, means for halting the machine, means for memorizing the length of the master cycle, and means for determining any error in the cycles subsequent to the master cycle in terms of duration difference between the subsequent cycles and the master cycle.

2. The device of claim 1, wherein said means for monitoring the movement of the yarns used for forming the fabric further constitute means for determining the advancement and the velocity of the advancement of the yarn.

3. The device of claim 1, wherein said comparator means comprise at least one counter and one comparator having a first input connected to said counter and a second input connected to means for memorizing information, said comparator comprising means for providing an error signal when said first and second inputs differ by more than a stored value contained in a limit register.

4. The device of claim 1, wherein said means for detecting consecutive errors are shift registers having intermediate outputs, and coincidence circuits connected to said intermediate outputs.

5. The device of claim 4, wherein said means for determining whether the consecutive errors are of the same type are comparison circuits, the logic AND gates with their inputs connected to the intermediate outputs of said shift registers, the said outputs of which constitute the inputs to an OR circuit.

6. The device of claim 1, wherein said means for memorizing the length of the master cycle comprise a counter controlled by means for indicating the velocity of the textile machine.

7. The device of claim 6, wherein said means for determining the error in a cycle duration comprise counter and comparator means for comparing the two counters when an end-of-cycle pulse arrives and for providing an error signal if the two differ by more than a value stored in a limit register.

8. The device of claim 1, wherein said means for sensing the commencement and end of the cycle comprise divider means for providing an end-of-cycle signal after a predetermined number of cycle commencement and termination signals provided by the machine.

9. The device of claim 1, further comprising means for calculating the percentage utilization of each individual yarn in producing the master article.

10. The device of claim 1, further comprising means for calculating the consumption of each individual yarn in producing the master article.

11. The device of claim 10, wherein said the means for calculating the consumption of each individual yarn are a multiplexer, a counter and a computing unit comprising means for processing the data provided by the counter and the data present in the memory means to provide the desired values as output.

12. The device of claim 1, further comprising means for sensing a reset signal provided by the machine and means for disenabling machine error control when said signal is present.

13. The device of claim 1, further comprising a system control means having is by means of an integrated logic circuit, a keyboard and a display unit.

14. A device for verifying the correct employment of yarns used by textile machines, comprising:

means for memorizing information regarding yarns movements obtained during the production of a master fabric, the production of said master fabric comprising a self-learning phase of the features of a production cycle of the master fabric, a number of sensor means equal to the number of yarns used by the machine during production, each of said sensor means sensing the movement or stoppage of the corresponding yarn, the velocity of travel of the corresponding yarn towards the machine and the breakage of yarn, said sensor means generating an electrical signal proportional to the state of the yarn whether in movement or stopped, first comparison means for comparing each signal generated by said sensor means during production in subsequent cycles with the information memorized during the production of the master fabric, said first comparison means emitting a signal indicative of an error between said signals generated by said sensor means and the information memorized during the production of the master fabric, the error being indicative of an error in the movement of the corresponding yarn of said sensor means corresponding to a breakage or unscheduled stoppage of the yarn, said first comparison means comprising means for detecting consecutive errors at each one of said sensor means, means for determining whether the consecutive errors are of the same type, and indicator means for indicating a general error, a general error being indicated only if an error indication is provided by both said means for detecting consecutive errors at a same one of said sensor means and said means for determining whether the consecutive errors are of the same type;

means for halting the machine, means for comparing the velocity of travel of each yarn measured by said corresponding sensor means with a corresponding velocity memorized during the production of the master cycle and for detecting a difference between said velocities, means for detecting the commencement and termination of the machine cycles, means for generating a timing signal based on the rotational speed of a drive shaft of the machine, memory means for memorizing signals generated by said timing means, and second comparison means for comparing data memorized by the memory means with the data memorized during the production of the master fabric and determining the difference between the data memorized by the memory means and the data memorized during the production of the master fabric, said difference being compared with an acceptability value, said data being compared at the end of the production cycle.

15. The device of claim 14, wherein said means for comparing the velocity of travel of each yarn comprise at least one counter and one comparator having a first input connected to said counter and a second input connected to means for memorizing information, said comparator providing an error signal if the two input values differ by more than a stored value contained in a limit register.

16. The device of claim 14, further comprising means for calculating the percentage utilization of each individual yarn used in said production cycle of the master fabric.

17. The device of claim 14, further comprising calculating means for calculating the consumption of each individual yarn used in said production cycle of the master fabric, said calculating means comprising a multiplexer, a counter and a computer unit for processing the data provided by said counter to provide a desired output.

18. The device of claim 14, further comprising system control means for controlling the operation of the textile machine, said system control means comprising an integrated logic circuit, a keyboard and a display unit.

19. The device of claim 14, further comprising means for sensing a reset signal emitted from the textile machine during its operation, and means for disenabling a machine error control when said signal has been detected.

* * * * *